US010308062B2

(12) United States Patent
Zhu et al.

(10) Patent No.: US 10,308,062 B2
(45) Date of Patent: Jun. 4, 2019

(54) OPTICAL ANTI-COUNTERFEITING ELEMENT AND OPTICAL ANTI-COUNTERFEITING PRODUCT UTILIZING THE SAME

(71) Applicants: ZHONGCHAO SPECIAL SECURITY TECHNOLOGY CO., LTD, Beijing (CN); CHINA BANKNOTE PRINTING AND MINTING CORP., Beijing (CN)

(72) Inventors: Jun Zhu, Beijing (CN); Baoli Zhang, Beijing (CN); Zhongdong Ye, Beijing (CN); Chunhua Hu, Beijing (CN); Xinyi Li, Beijing (CN)

(73) Assignees: ZHONGCHAO SPECIAL SECURITY TECHNOLOGY CO., LTD., Beijing (CN); CHINA BANKNOTE PRINTING AND MINTING CORP., Beijing (CN)

( * ) Notice: Subject to any disclaimer, the term of this patent is extended or adjusted under 35 U.S.C. 154(b) by 0 days.

(21) Appl. No.: 15/765,285

(22) PCT Filed: Nov. 30, 2016

(86) PCT No.: PCT/CN2016/107950
§ 371 (c)(1),
(2) Date: Apr. 2, 2018

(87) PCT Pub. No.: WO2017/092667
PCT Pub. Date: Jun. 8, 2017

(65) Prior Publication Data

US 2018/0281502 A1 Oct. 4, 2018

(30) Foreign Application Priority Data

Dec. 1, 2015 (CN) ..... 2015 1 0854868

(51) Int. Cl.
*B42D 25/342* (2014.01)
*B42D 25/21* (2014.01)
(Continued)

(52) U.S. Cl.
CPC ..... *B42D 25/342* (2014.10); *B42D 25/21* (2014.10); *B42D 25/30* (2014.10); *B42D 25/328* (2014.10);
(Continued)

(58) Field of Classification Search
CPC .. B42D 25/342; B42D 25/328; B42D 25/364; B42D 25/351; B42D 25/21
(Continued)

(56) References Cited

U.S. PATENT DOCUMENTS 4,765,656 A 8/1988 Becker et al.
4,892,336 A 1/1990 Kaule et al.
(Continued)

FOREIGN PATENT DOCUMENTS

CN 1552589 12/2004
CN 1271106 8/2006
(Continued)

OTHER PUBLICATIONS

A. Westcott, U.S. Pat. No. 34,082 issued Jan. 7, 1862.
(Continued)

*Primary Examiner* — Justin V Lewis
(74) *Attorney, Agent, or Firm* — Wegman, Hessler & Vanderburg

(57) ABSTRACT

Disclosed are an optical anti-counterfeiting element and an optical anti-counterfeiting product utilizing the same, the optical anti-counterfeiting element comprising: a substrate (2) having a first surface (31) and a second surface (32) that are opposed to each other, a sampling and synthesizing layer (21) on a first surface (31) of the substrate (2); and a
(Continued)

micro-image layer (22) on a second surface (32) of the substrate (2), the micro-image layer (22) including a first region at least partially covered with a coating (221) and a second region comprising at least two sub-regions each at least partially covered with a color function layer (222, 223), the color function layers (222, 223) in respective sub-regions and the coating (221) in the first region have different color characteristics, respectively, and the micro-image layer (22) can be sampled and synthesized by the sampling and synthesizing layer (21) to form an image. Such optical anti-counterfeiting element and optical anti-counterfeit product are easy to identify and difficult to counterfeit.

20 Claims, 6 Drawing Sheets

(51) Int. Cl.
*B42D 25/351* (2014.01)
*B42D 25/328* (2014.01)
*B42D 25/364* (2014.01)
*B42D 25/30* (2014.01)
*B44F 1/00* (2006.01)

(52) U.S. Cl.
CPC ..... *B42D 25/351* (2014.10); *B42D 25/364* (2014.10); *B44F 1/00* (2013.01)

(58) Field of Classification Search
USPC ..... 283/72, 74, 94, 98, 901
See application file for complete search history.

(56) References Cited

U.S. PATENT DOCUMENTS

| | | | | |
|---|---|---|---|---|
| 5,712,731 | A | 1/1998 | Drinkwater et al. | |
| 2003/0179364 | A1 | 9/2003 | Steenblik et al. | |
| 2010/0307705 | A1 | 12/2010 | Rahm et al. | |
| 2012/0033305 | A1 | 2/2012 | Moon et al. | |
| 2012/0193905 | A1* | 8/2012 | Schilling | G02B 3/005 283/74 |

FOREIGN PATENT DOCUMENTS

| | | |
|---|---|---|
| CN | 1906547 | 1/2007 |
| CN | 101120139 | 2/2008 |
| CN | 101269610 | 9/2008 |
| CN | 101346244 | 1/2009 |
| CN | 101434176 | 5/2009 |
| CN | 101443692 | 5/2009 |
| CN | 101563640 | 10/2009 |
| CN | 102405434 | 4/2012 |
| CN | 102497995 | 6/2012 |
| CN | 102844198 | 12/2012 |
| CN | 103080780 | 5/2013 |
| CN | 103358808 | 10/2013 |
| CN | 104656167 | 5/2015 |
| CN | 104898290 | 9/2015 |
| GB | 2481330 | 12/2011 |
| GB | 2496351 | 5/2013 |
| WO | 2005052650 | 6/2005 |
| WO | 2007133613 | 11/2007 |
| WO | 2008008635 | 1/2008 |
| WO | 2011/107791 | 9/2011 |
| WO | 2010110370 | 10/2012 |

OTHER PUBLICATIONS

International Search Report for International Application No. PCT/CN2016/107950 dated Feb. 28, 2017.
1st Office Action of Chinese Patent Application No. 201510854868.2 dated Oct. 10, 2016.

* cited by examiner

OPTICAL ANTI-COUNTERFEITING ELEMENT AND OPTICAL ANTI-COUNTERFEITING PRODUCT UTILIZING THE SAME

CROSS-REFERENCE TO RELATED APPLICATION

This application is a national phase of International Patent Application No. PCT/CN2016/107950 filed Nov. 30, 2016, and which claims the priority filing benefit of Chinese Patent Application No. 201510854868.2 filed Dec. 1, 2015, and which are incorporated herein by reference in their entirety.

TECHNICAL FIELD

The present invention relates to the optical anti-counterfeiting field, and in particular, to an optical anti-counterfeiting element and an optical anti-counterfeiting product utilizing the same.

BACKGROUND

In order to prevent counterfeiting by means of scanning and copying, optical anti-counterfeiting technology is widely used in various high-security or high value-added printed matters such as banknotes, cards and product packaging, and has achieved very good effects.

Patent documents CN101563640, CN101443692, CN101120139, CN101346244, U.S. Pat. Nos. 5,712,731, 0,034,082, 4,765,656, 4,892,336, CN1271106 and CN1552589 disclose the same kind of anti-counterfeiting elements with a micro-lens array and a micro image-text array on two surfaces of a substrate respectively, wherein the micro image-text array is located near the focal plane of the micro-lens array and reproduces images with a certain depth of field or dynamic effects through the Moiré magnification of the micro image-text array by the micro-lens array.

To ensure that Moiré magnified patterns are easy to identify under different ambient light conditions, the micro image-text array and its background need to have sufficient contrast in color or brightness, that is, the micro image-text array needs to be colorized. Given that the required structure of micro image is very fine (about a few microns), such an accuracy grade is unreachable by utilizing a general printing technology which has a printing stroke of 20 microns or more.

There are two colorizing methods at present. One method is disclosed in patent documents (e.g., CN1906547A) as follows: forming grooves with a certain depth in the micro image-text region, filling the grooves with stain material by means of the blade coating processes, and the excessive materials which are located beyond the micro image-text region shall be substantially removed. In order to obtain a favorable colorizing effect, this method is significantly restrictive on the width of lines and depth of grooves of the micro image as well as matching relationship therebetween.

The other method is applied based on the micro-nano structure, for instance, patent document US20030179364 discloses a solution of performing a black colorization of the micro image by means of an optical absorbing structure with a high width-to-depth ratio, and the patent document US20100307705A1 discloses a solution of performing a colorization of the micro image by filling with nanoparticles or benched metallic nanostructure.

However, the above two coloring methods have defects in different aspects: US20030179364 can hardly reach a colorful tinting, and the benched structure and the manner of planar covering the structure by the coating utilized in US20100307705A1 can hardly be applied in the production.

SUMMARY

An object of the present invention is to provide an optical anti-counterfeiting element and an optical anti-counterfeiting product utilizing the same, which is easy to identify and difficult to counterfeit.

The present invention provides an optical anti-counterfeiting element comprising: a substrate having a first surface and a second surface that are opposed to each other; a sampling and synthesizing layer on a first surface of the substrate: and a micro-image layer on a second surface of the substrate, the micro-image layer including a first region at least partially covered with a coating and a second region comprising at least two sub-regions each at least partially covered with a color function layer, the color function layers in respective sub-regions and the coating in the first region have different color characteristics, respectively, and the micro-image layer can be sampled and synthesized by the sampling and synthesizing layer to form an image.

The present invention also provides an optical anti-counterfeiting product utilizing the above optical anti-counterfeiting element.

The optical anti-counterfeiting element and optical anti-counterfeiting product according to the present invention has the following advantages:

(1) The micro-image layer is formed of a coating and multiple color function layers having different color characteristics, the micro-image layer will have information of multiple colors so that the image obtained by sampling and synthesizing has multi-color characteristics and solves the problem that such product has a single color.

(2) Since the color characteristics of the coating and the plurality of color function layers may be arbitrarily defined, the image obtained by sampling and synthesizing has a strong contrast between colors.

(3) Because the multi-color characteristics of the sampled and synthesized image can correspond with the sampled and synthesized image, a novel optical anti-counterfeiting feature is formed, which is easy to identify and can produce a stronger attraction to the public and a higher anti-counterfeiting capability.

(4) The optical anti-counterfeiting element according to the present invention may be mass produced by means of the general-purpose equipment in the field, and the process is highly feasible.

DETAILED DESCRIPTION OF THE INVENTION

The optical anti-counterfeiting element and the optical anti-counterfeiting product utilizing the same according to the present invention will be described in detail below with reference to the accompanying drawings. It should be understood that the drawings and detailed description are only of the preferred embodiments of the present invention, and are not intended to limit the protection scope of the present invention in any way. Those skilled in the art should understand that the grayscale and size ratios in all the drawings are only schematic, and do not represent actual color and size ratios.

Figure 1A:
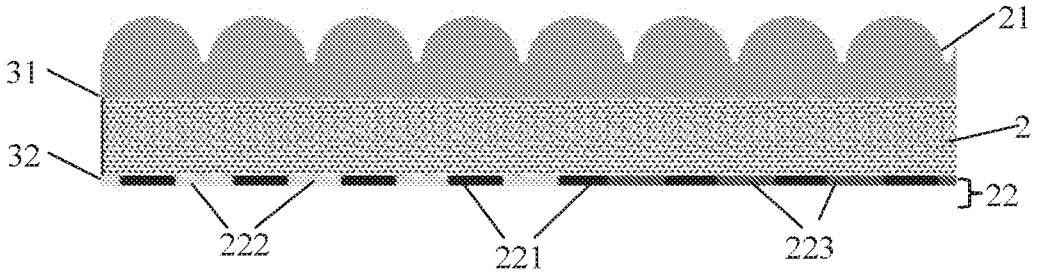
FIG. 1*a* is a cross-sectional view of an optical anti-counterfeiting element according to one embodiment of the present invention.

As shown in FIG. 1*a*, the optical anti-counterfeiting element according to one embodiment of the present invention comprises a substrate 2, a sampling and synthesizing layer 21, and a micro-image layer 22. The substrate 2 includes a first surface 31 and a second surface 32 that are opposed to each other. The sampling and synthesizing layer 21 is disposed on the first surface 31 of the substrate 2. The micro-image layer 22 is disposed on the second surface 32 of the substrate 2 and comprises a first region at least partially covered with a coating 221 and a second region comprising at least two sub-regions each at least partially covered with a color function layer (for example, FIG. 1*a* shows two sub-regions covered with color function layers 222, 223, respectively), the color function layers (222, 223) in respective sub-regions and the coating 221 in the first region have different color characteristics, respectively, and the micro-image layer 22 can be sampled and synthesized by the sampling and synthesizing layer 21 to form an image. In other words, the coating 221 in the first region and the color function layers 222, 223 in the second region together form the micro-image layer 22.

Figure 1B:
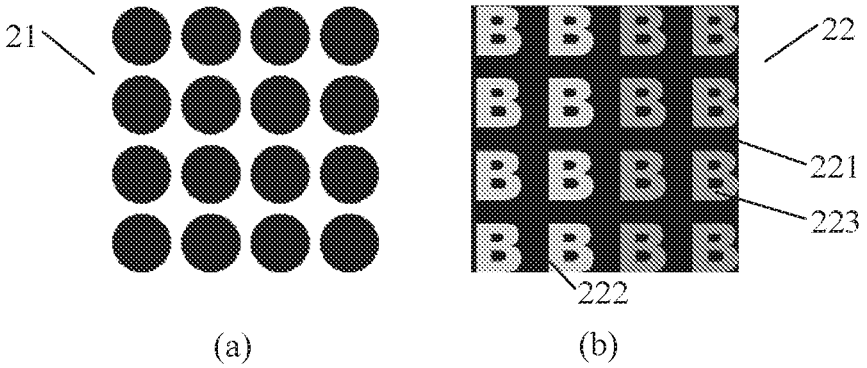
FIG. 1*b* is a schematic diagram of the arrangement of the sampling and synthesizing layer and the micro-image layer of the optical anti-counterfeiting element according to one embodiment of the present invention.

Taking the second region comprising two sub-regions shown in FIG. 1*a* as an example, according to a particular embodiment of the optical anti-counterfeiting element of the present invention, the sampling and synthesizing layer 22 adopts an array of spherical micro-lenses having a diameter of 21 μm arranged in a rectangular arrangement (as shown in FIG. 1*b* (*a*)), the arrangement period is 23 μm, the height of the microlens is 7 μm, the thickness of the substrate 2 is 20 μm. The coating 221 is an Al layer having a thickness of 40 nm, and the color function layers 222, 223 are red and green nano-inks respectively. FIG. 1*b*(*b*) is a top view of the micro-image layer 22 synthesized of the coating 221 and the color function layers 222, 223, in which the Al coating 221 forms the background (i.e., the first region) of the micro-image layer 22, the red color function layer 222 and the green color functional layer 223 form strokes (i.e., the second region) of the micro-image layer 22 in a region. The arrangement period of the synthesized "B" micro-image array is the same as that of the micro-lens array in the sampling and synthesizing layer 22. However, the micro-image array and the micro-lens array has a difference of 0.3 degrees in the orientation. Based on the above configuration, the optical features shown in FIG. 1*c* (in the case of a tilting-type optical anti-counterfeiting element) and in FIG. 1*d* (in the case of a rotating-type optical anti-counterfeiting element) are formed. That is, when tilting or rotating the optical anti-counterfeiting element, the human eye will be able to observe that the sampled and synthesized image "B" is capable of forming colorful dynamic features, i.e., the background of the image presents a silvery white of metal Al and the stroke portion of "B" has two colors.

In particular, when the letter moves from the sub-region where the red color function layer 222 is located to the sub-region where the green color function layer 223 is located, the color of the letter "B" will change from red to green.

Figure 1C:
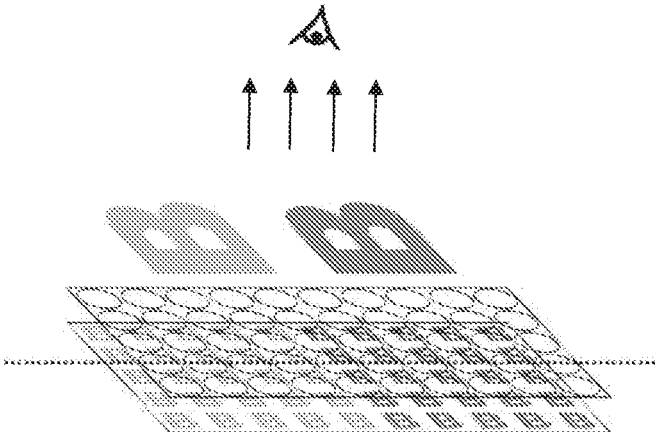
FIGS. 1*c* and 1*d* are schematic view of the optical features of the optical anti-counterfeiting element according to one embodiment of the present invention.
Figure 1D:
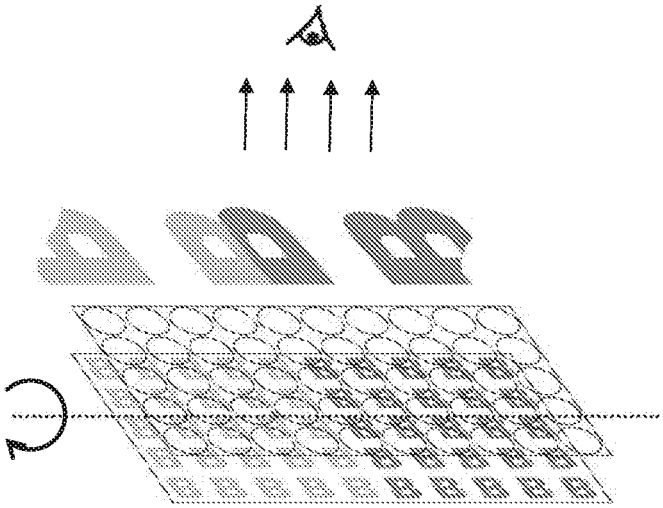

The sampling and synthesizing layer 21, the micro-image layer 22, the coating 221, the color function layers 222, 223, and the resulting anti-counterfeiting features are described with reference to the embodiments shown in FIGS. 1*b* and 1*c*. In fact, more preferred and combined to solutions are available for respective aspects of the optical anti-counterfeiting element according to the present invention. The details will be described below.

In a preferred embodiment according to the present invention, the sampling and synthesizing layer 21 may be formed of at least one of a micro-pore array, a micro-grid array, a micro-lens array, and other micro-sampling tools capable of imaging the micro-image layer 22. The micro-pore array, the micro-grid array and the micro-lens array may be an non-periodic array, a random array, a periodic array, a local periodic array respectively composed of a plurality of micro-pore units, micro-grid units and micro-lens units, or any combination thereof. The micro-lens unit may be a refractive micro-lens, a diffractive micro-lens or a combination thereof, wherein the refractive micro-lens may be a spherical micro-lens, a parabolic micro-lens, an ellipsoid micro-lens, a cylinder micro-lens, a polygon micro-lens, or any other geometrical optics-based micro-lens having any geometry, or any combination thereof, the diffractive micro-lens may be selected from a group consisting of harmonic diffractive micro-lens, plane diffractive micro-lens and Fresnel zone plate. Among these, except for the Fresnel zone plate, the specific form of other micro-lenses may select a continuous curved surface or stepped lens as a micro lens unit.

Preferably, the micro-pore array, the micro-grid array and the micro-lens array may present at least one of a square arrangement, a rectangular arrangement, a hexagonal arrangement, and other quadrangular or polygonal arrangement. In addition, other arrangements, such as a circular arrangement, an elliptical arrangement are also feasible. For example, FIG. 1*b*(*a*) exemplarily illustrates a micro-lens array arranged in a rectangular arrangement, and FIG. 1*b*(*b*) exemplarily illustrates a periodic array formed when the micro-image layer 22 in the optical anti-counterfeiting element shown in FIG. 1*a* synthesized of the coating 221, the color function layer 222 and the color function layer 223 is a rectangular arrangement of letters "B".

Preferably, the micro-image layer 22 may be an non-periodic array, a random array, a periodic array, a local periodic array formed of a plurality of micro-imaging units defined according to the sampling and synthesizing layer 21 and the desired effect, or any combination thereof, so as to ensure that the sampling and synthesizing layer 21 can sample and synthesize the micro-image layer 22 to form an image. For example, in the case that the sampling and synthesizing layer 21 is a layer of micro-lens array, the arrangement period of the micro-lens array is preferably the same as that of the micro-image array in the micro image layer 22. In addition, the relative stagger angle between the micro-lens array and the micro-image array is preferably in the range of −0.3 degrees to 0.3 degrees. The formed image features may be one or combination of sinking, floating, dynamic, scaling, rotating, multi-channel conversion, continuous change of depth of field, three-dimensional graphics, continuous multi-frame animation and etc. For details, reference may be made to "Research on Display Technology of Micro-lens Array" (Micronanoelectronic Technology, 2003. No. 6, page 29) and "Micro-lens Array Display Technology Research" (Eleventh National Electron Beam•Ion Beam•Photon Beam Symposium, October 2001, page 226) and etc. In fact, the optical anti-counterfeiting element of the present invention is capable of providing novel and rich optical anti-counterfeiting features such as the optical anti-counterfeiting features shown in FIGS. 1*c* and 1*d*.

Preferably, the periodic or local periodic sampling and synthesizing layer 21 and the micro-image layer 22 in the optical anti-counterfeiting element according to the present invention may have an image period of 10 μm to 200 μm, preferably 15 μm to 50 μm: the sampling and synthesizing layer (e.g., as micro-lens array layer) 21 may have a focal length of 10 μm to 200 μm, preferably 15 μm to 40 μm; the processing depth of the sampling and synthesizing layer (e.g., micro-lens array layer) 21 is preferably less than 15 μm, more preferably 0.5 μm to 10 μm. In addition, the difference between the thickness of the substrate 2 and the focal length of the sampling and synthesizing layer 21 is preferably less than 8 μm, and more preferably the difference is less than 3 μm.

Preferably, the sampling and synthesizing layer 21 may be obtained through micro-nano processing such as optical exposure, electron beam exposure or the like, and may also be achieved through processes such as hot-melt reflow and the like, and batch-copied by means of processes such as UV casting, molding, nanoimprint and so on.

Preferably, the coating 221 in the optical anti-counterfeiting element according to the present invention may be a single-layer metal coating, a multi-layer metal coating, a single-layer medium layer, a multi-layer medium layer, an interference-type multi-layer film structure, or the like. The color function layers 222, 223 may be at least one of an ink, a pigment, a dye, an optically variable ink, a liquid crystal optically variable layer, a co-extrusion optically variable film, a single-layer metal coating, a multilayer metal coating, a single-layer medium layer, a multi-layer medium layer, an interference-type multi-layer film structure, or the like. The coating 221 and the color function layers 222, 223 have different color characteristics respectively so as to form contrast to realize the function of the color micro-image layer 22. The interference-type multilayer film structure may be any one of the following three types of interference type multilayer coatings or any combination thereof: an interference-type multilayer film structure (simply described as an "absorption layer/low refractive index medium layer/reflective layer" structure) formed by sequentially stacking an absorption layer (for example, a semitransparent metal layer), a low refractive index medium layer and a reflective layer, where the absorption layer is in contact with the second surface 32; an interference-type multilayer film structure formed by sequentially stacking a high refractive index medium layer, a low refractive index medium layer and a high refractive index medium layer; and an interference-type multilayer film structure (simply described as an "absorption layer/high refractive index medium layer/reflective layer" structure) formed by sequentially stacking an absorption layer (for example, a semitransparent metal layer), a high refractive index medium layer and a reflective layer, where the absorption layer is in contact with the second surface 32. In an embodiment according to the present invention, the material of the high refractive index medium layer with a refractive index of 1.7 or more may be ZnS, TiN, $TiO_2$, TiO, $Ti_2O_3$, $Ti_3O_5$, $Ta_2O_5$, $Nb_2O_5$, $CeO_2$, $Bi_2O_3$, $Cr_2O_3$, $Fe_2O_3$, $HfO_2$, ZnO, etc; the material of the low refractive index medium layer with a refractive index less than 1.7 may be $MgF_2$, $SiO_2$, etc; the material of the metal coating or the reflective layer may be a metal such as Al, Cu, Ni, Cr, Ag, Fe, Sn, Au, Pt and etc, a mixture thereof, or an alloy thereof, the material of the semitransparent metal layer (or absorption layer) may be a metal such as Al, Cr, Ni, Cu, Co, Ti, V, W, Sn, Si, Ge and etc, a mixture thereof, or an alloy thereof. In addition, in embodiments of the present invention, a high refractive index may refer to a refractive index in the range of 1.7 to 3, and a low refractive index may refer to a refractive index of less than 1.7.

The above-mentioned interference-type multilayer film structure can form a Fabry-Perot resonant cavity, which is selective to the incident white light so that the emergent light contains only certain wavebands to form a specific color. When the incident angle changes, the corresponding optical path changes and the interference waveband also changes, resulting in that the color presented to the observer also changes, whereby optically variable effects are obtained.

In the case that at least one of the coating 221 and the color function layers 222, 223 is at least one of a single-layer metal coating, a multi-layer metal coating, a single-layer medium layer, a multi-layer medium layer and an interference-type multilayer film structure, it can be formed by physical and/or chemical deposition methods, for example, including but not limited to thermal evaporation, magnetron sputtering, MOCVD, molecular beam epitaxy and the like.

It should be noted that although the second region shown in FIG. 1*a* includes two sub-regions, In fact the second region of the micro-image layer 22 may include more than two sub-regions, and each sub-region may have different color characteristics. The color characteristics of these sub-regions are combined with the color characteristics of the coating 221, such that the micro-image layer 22 and the sampled and synthesized image have color image characteristics.

The method of fabricating the optical anti-counterfeiting element according to the present invention is described below with reference to FIG. 2. For the method of forming the coating 221, reference may be made to China Patent CN104647936A. Here, only two fabrication methods are given by way of example. It should be understood that the methods are only a specific description of an embodiment of the optical anti-counterfeiting element of the present invention and is not intended to limit the scope of the present invention in any way.

Figure 2:
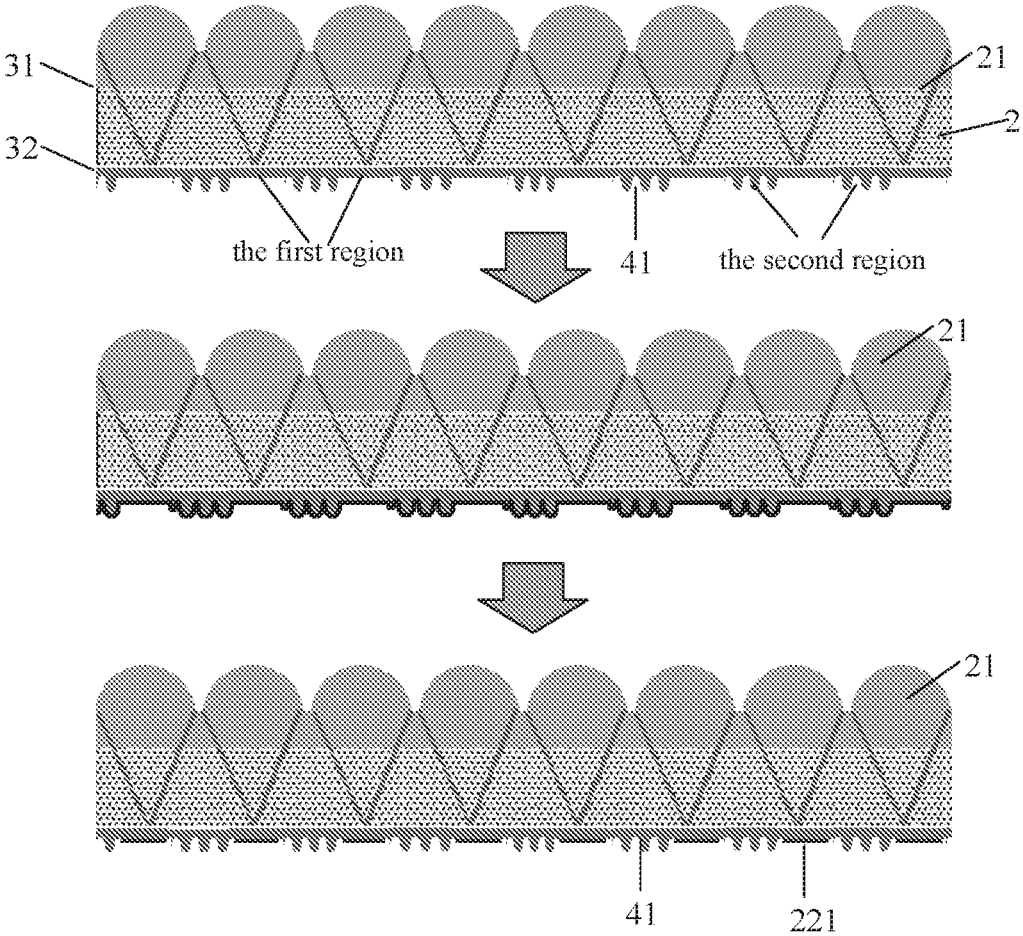
FIG. 2 is a schematic view of a step of fabricating a coating in a micro-image layer of an optical anti-counterfeiting element according to one embodiment of the present invention.

The fabrication method shown in FIG. 2 is aimed at fabricating the optical anti-counterfeiting element shown in FIG. 1*a*. First, a sampling and synthesizing layer 21 is formed on the first surface 31 of the substrate 2 and a sinusoidal one-dimensional sub-wavelength optical grating 41 is formed on the second region of the second surface 32 of the substrate 2, the optical grating has a period of 245 nm and a depth of 150 nm. The first region of the second surface 32 is flat. Then, an Al layer having a thickness of 60 nm (with reference to the thickness on the first region) is directly deposited on the second surface 32 of the substrate 2, and then an Si layer having a thickness of 50 nm (with reference to the thickness on the second region) is deposited on the Al layer, thereafter the entire structure is immersed in NaOH solution (temperature: 40° C., concentration: 5%) for 18 seconds, resulting in that the Si layer and the Al layer formed on the second region completely disappear, while the Al layer formed on the first region is still present, so that a coating 221 is formed. In this technical solution, the sub-wavelength optical grating 41 used in the second region has a higher structural width-to-depth ratio so that the surface area per unit apparent area thereof is much larger than that of the first region, thereby ensuring that the thickness of the deposited layer of the second region is thinner when homomorphically covering and depositing the Al layer or the Si layer under the same deposition conditions. As a result, when the NaOH solution completely dissolves the Si layer on the second region, the Si layer on the first region still does not dissolve completely, and in the next stage, when the NaOH solution completely dissolves the Al layer on the second region, the Si layer on the first region remains and protects the Al layer it covers from corrosion by the NaOH solution. This precisely forms the desired coating 221 so that the image background of the micro-image layer 22 of the optical anti-counterfeiting element shown in FIG. 1*a* can be formed.

Preferably, the above-mentioned sub-wavelength optical grating 41 can be obtained through micro-nano processing such as optical exposure, electron beam exposure and the like, and batch-copied by a processing method such as UV casting, press molding and nanoimprinting.

Figure 3:
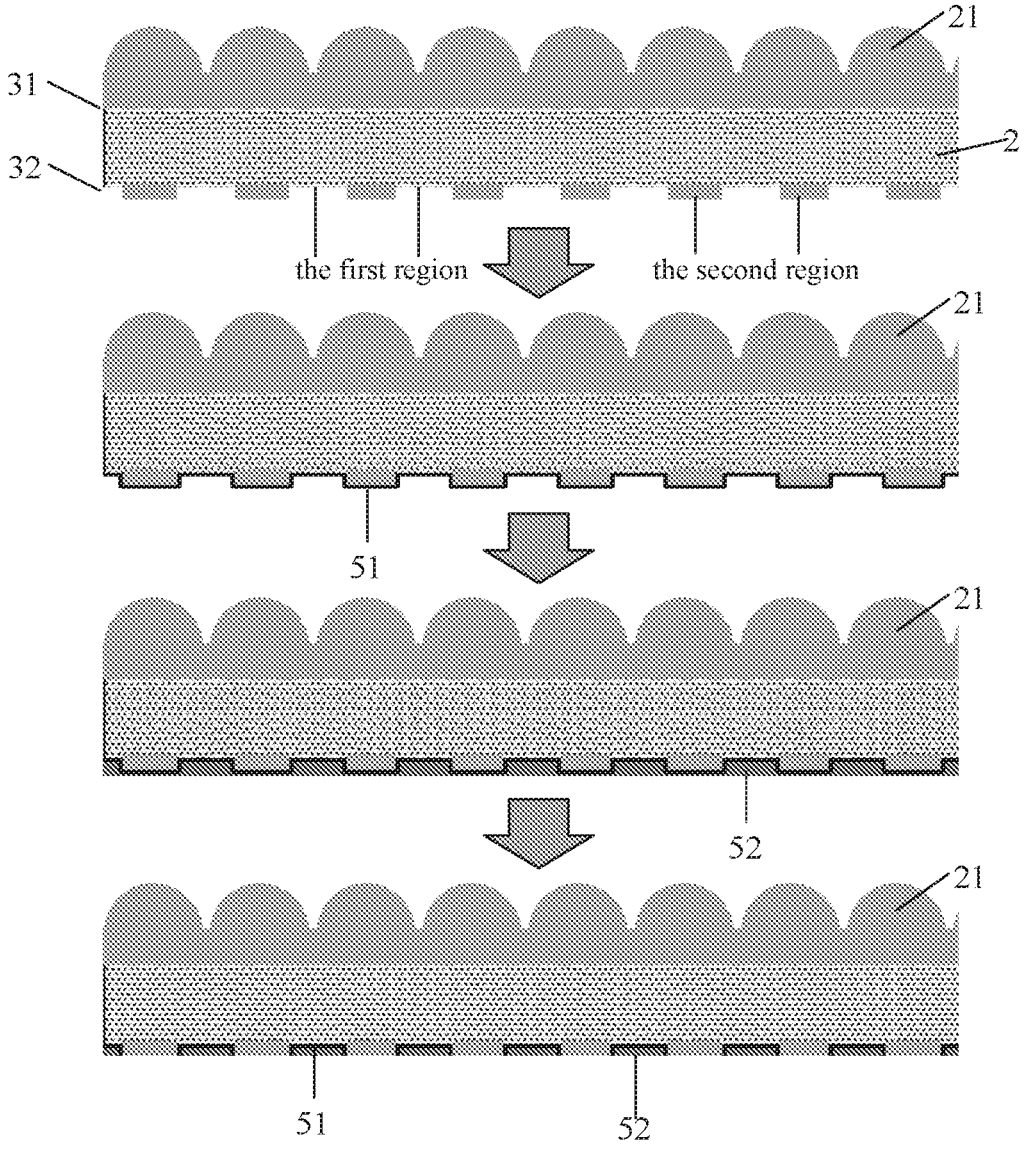
FIG. 3 is a schematic view of another step of fabricating a coating in a micro-image layer of an optical anti-counterfeiting element according to one embodiment of the present invention.

FIG. 3 shows an alternative method of fabricating the optical anti-counterfeiting element shown in FIG. 1*a*. First, a structure in which the second region is convex upwards with respect to the first region is formed on the second surface 32 of the substrate 2, with the second region higher than the first region by 1.5 μm, at the same time a sampling and synthesizing layer 21 is formed on the first surface 31 of the substrate 2. Then, an Al layer having a thickness of 60 nm (with reference to the thickness on the first region) is directly deposited on the second surface 32, and then a polyester material layer 52 having a thickness of 1.5 μm is coated on the Al layer, thereafter the entire structure is immersed in NaOH solution (temperature: 40° C., concentration: 5%) for 30 seconds, resulting in that the polyester material layer and the Al layer formed on the second region completely disappear, while the Al layer formed on the first region is still present, so that a coating 221 as shown in FIG. 1*a* is formed. In this technical solution, since the first region is recessed by 1.5 μm relative to the second region, the coated polycarbonate layer tends to converge toward the recessed region due to the levelling property of the material during the coating, so that the polycarbonate layer of the first region is thicker relative to the second region. As a result, the surface of the Al layer of the second region has a relatively thin polycarbonate layer that is more susceptible to corrosion when immersed in the NaOH solution. This precisely forms the desired coating 221 so that the image background of the micro-image layer 22 of the optical anti-counterfeiting element shown in FIG. 1*a* can be formed.

The polyester material layer 52 used as a protective layer can be achieved, for example, by means of general printing, coating or depositing. In fact, there may be more material preferences, which may be, for example, opaque, semitransparent or fully transparent coatings. Preferably, the protective layer is a polymer, in particular a polymer comprising cellulose. For example, the polymer forming the protective layer may comprise a mixture of nitrocellulose (preferably, nitroalcohol) and a resin (such as gum arabic and rosin) added to improve the resistance to subsequent handling of the protective layer, etc. In a preferred embodiment, the primary resin is a polyester resin material comprising the following components: (1) about 20% to about 30% by weight of a primary resin, said resin being a polyester having a hydroxyl number greater than 120, said polyester being a branched hydroxy polyester having a viscosity of 25000±5000 mPa·s; (2) about 10% to about 25% by weight of nitrocellulose, said nitrocellulose being a low nitrogen nitrocellulose with a nitrogen content of less than 12.4%; (3) about 5% to about 25% by weight of a crosslinking agent, the crosslinking agent being an isocyanate oligomer; and (4) about 20% to about 60% by weight of a solvent.

Figure 4:
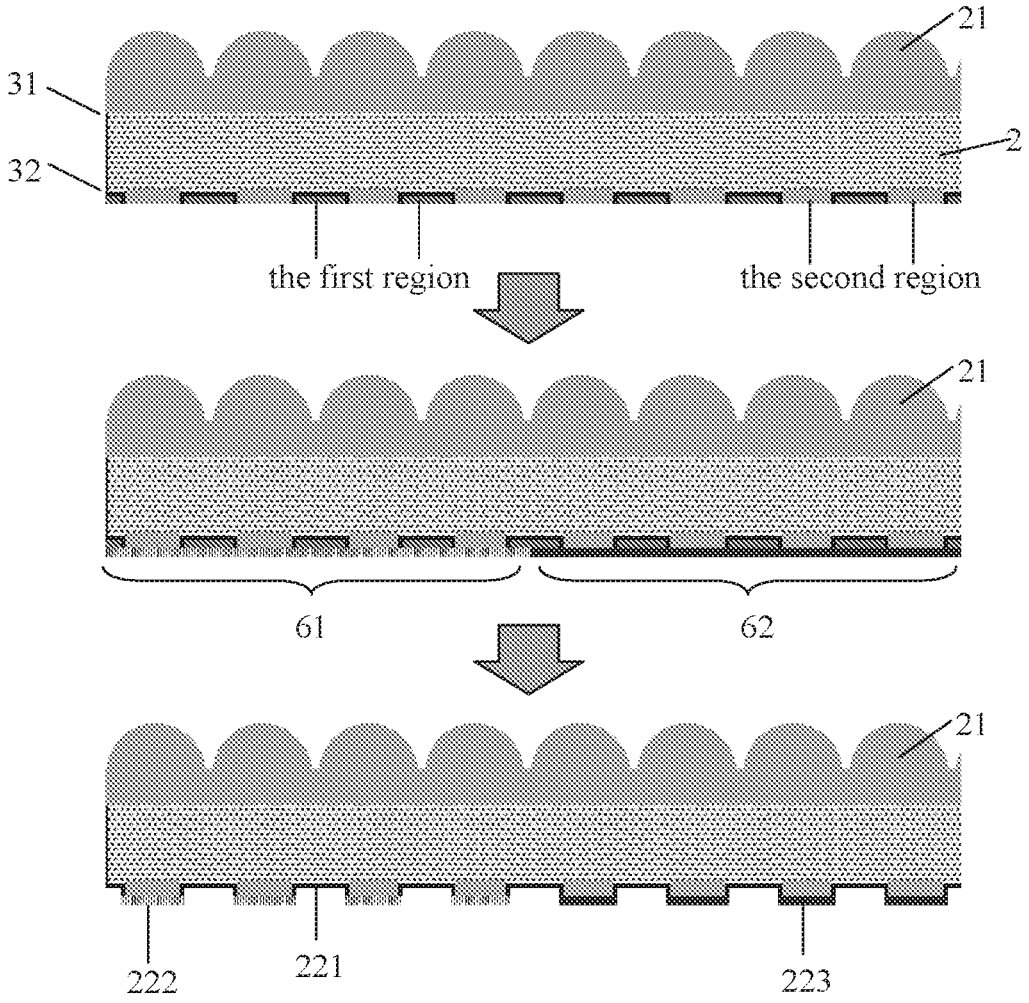
FIG. 4 is a schematic view of a step of fabricating a color function layer in a second region on the basis of the fabrication step shown in FIG. 3.

The method for fabricating the color function layers 222, 223 in the optical anti-counterfeiting element shown in FIG. 1*a* will be described below with reference to FIG. 4, this method is continuation of the method for fabricating the sampling and synthesizing layer 21 and the coating 221 as shown in FIG. 3. For ease of understanding, the last step in FIG. 3 is shown in FIG. 4. After the sampling and synthesizing layer 21 and the coating 221 are fabricated, a multi-color printer is used to overprint the coating 221 formed on the second surface 32 of the substrate 2 with red and green nano-inks to a thickness of 2 μm to form two regions 61, 62. As shown in FIG. 4, the two regions are directly connected. Of course, they also can be adjusted according to the level of the process or the design requirement to be crossed or separated. At this time, the red and green nano-inks used as the color function layers 222 and 223 cover not only the first region, but also the second region in the micro-image layer 22. The entire structure is then immersed in a solvent, the selection of which depends on the selection of the protective layer using polycarbonate as the primary resin, and when the auxiliary of the protective layer is selected to be a fat-soluble or alcohol-soluble material, the solvent is accordingly selected to be a lipid (such as ethyl acetate) or alcohol (such as isopropanol). In this embodiment, an alcohol-soluble material is used as an auxiliary of the protective layer, and the solvent is selected as isopropanol. During the immersion process, a portion of the first region covered by the red nano-ink and the green nano-ink, that is, a portion covering the coating 221 (Al layer) is etched to the protective layer by the immersed isopropanol, so that the protective layer is dissolved and the isopropanol-insoluble nano-ink is jointly exfoliated. Finally, both of the color function layers 222, 223 cover only two sub-regions of the second region, and only the coating 221 is formed in the first region, thus completing the fabrication of the optical anti-counterfeiting element shown in FIG. 1*a*.

It should be noted that although the color function layer in the first region is removed in the fabrication process shown in FIG. 4, in practice, it may not be necessary to remove the color function layer in the first region depending on the design requirements.

For example, when a transparent or semitransparent material such as ZnS, $Al_2O_3$, $MgF_2$, $SiO_2$, cryolite and the like is used as the coating 221, if the color function layer in the first region is not removed, then the final optical anti-counterfeiting element will enable the human eye to observe through the sampling and synthesizing layer 21 the color of the first region that is co-provided by the coating 221 and the color function layer covered on the surface thereof. If the designer does not approve the color, the color function layer in the first region may be removed by means of the steps shown in FIG. 4. If the designer approves the color, the color function layer in the first region may not be removed because even if it is not removed, it is possible to have difference in color characteristics between the first region and respective sub-regions of the second region due to the presence of the coating 221.

For another example, if the coating 221 is opaque with Al, Cu or the like, it will block the color function layer coated on the first region, so that the color function layer in the first region does not affect the sampling and synthesizing process of the sampling and synthesizing layer 21. In this case, it also may be selected to not remove the color function layer in the first region.

Since the optical anti-counterfeiting element according to the present invention adopts the structure as described above, it will have a variety of interesting and advantageous optical anti-counterfeiting features that make the optical anti-counterfeiting element of the present invention more resistant to forgery and easier to identify by the general public. The advantageous optical anti-counterfeiting effects that can be achieved by the optical anti-counterfeiting element according to the present invention will be described below with reference to FIGS. 5*a*-5*d*.

Figures 5A, 5B, 5C, 5D:
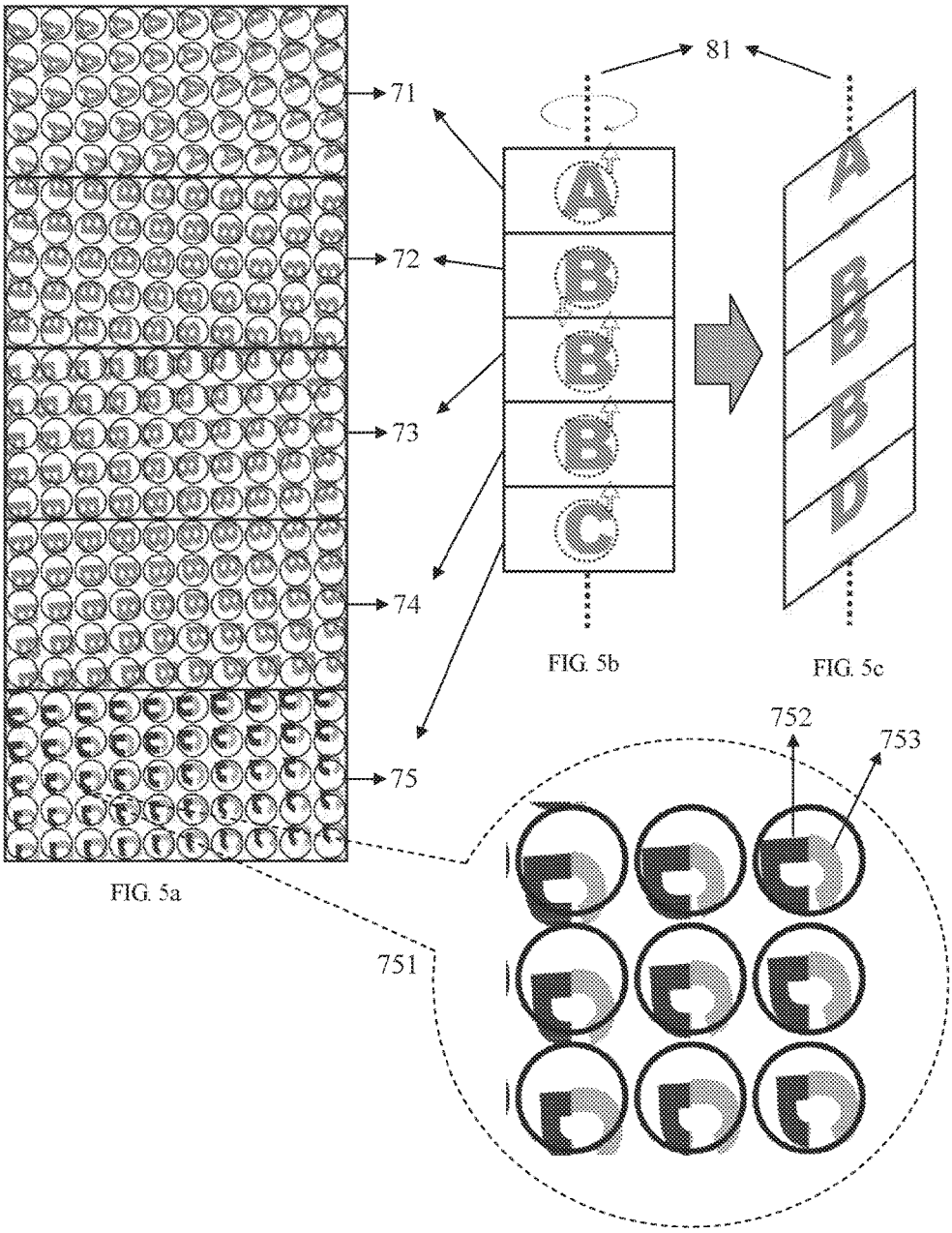
FIGS. 5*a*-5*d* are schematic view of embodiments of the advantageous effects achieved by the anti-counterfeiting element according to the present invention.

FIGS. 5*a*-5*d* illustrate an embodiment of the optical anti-counterfeit element according to the present invention having a total of five regions 71-75. FIG. 5*a* is a top view of the optical anti-counterfeiting element, illustrating the relationship of the respective parts. A rectangular array of spherical micro-lenses is used as the sampling and synthesizing layer 21 for each of the regions, the micro-lens has a diameter of 25 μm, the arrangement period of the micro-lens array is 27 μm, the height of the micro-lens is 10.2 μm, the thickness of the substrate 2 is 19 μm.

The content of the micro-image layer in the region 71 consists of letters "A" having an arrangement period of 27 μm, and the stagger angle in relation to the micro-lens arrays is +0.4 degrees.

The content of the micro-image layer in the region 72 consists of letters "B" having an arrangement period of 27 μm, and the stagger angle in relation to the micro-lens arrays is −0.3 degrees.

The content of the micro-image layer in the region 73 consists of letters "B" having an arrangement period of 27 μm, and the stagger angle in relation to the micro-lens arrays is +0.3 degrees.

The content and arrangement of the micro-image layer in the region 74 coincide with those of the region 73.

The content of the micro-image layer in the region 75 consists of letters "C" and "D", and the arrangement thereof is as shown in the enlarged schematic region 751. Just below each micro-lens, the region 75 is equally divided into two portions 752 and 753, of which the portion 752 is for placing an array containing the letter "D" and the portion 753 is for placing an array containing the letter "C". In the present embodiment, both the "D" and "C" arrays adopt an arrangement having a period of 27 μm and a stagger angle of +0.3 degrees in relation to the micro-lens array. The two arrays are incorporated in the micro-image layer 22 of the region 75 by portions 752 and 753 in a split and interpenetrating manner.

The micro-image layer 22 in the regions 71-75 adopts Al with a thickness of 60 nm as the coating 221 and uses the coating 221 as the background of the text or image of the micro-image layer. In fact, the coating 221 and the color function layers in the respective regions may be any portion of the image in the micro-image layer, they may also be a text or image, or they may be a portion of the image or background thereof, such as the "/" stroke of the letter "A".

A red nano-ink is employed in the region 71 as a color function layer (not shown) of this sub-region in the second region, that is, a stroke portion of the letter "A" in the region 71.

A green metal ink is employed in the region 72 as a color function layer (not shown) of this sub-region in the second region, that is, a stroke portion of the letter "B" in the region 72.

An optically variable ink (e.g., OVI ink commercially available from Sicpa Inc, which manifests magenta when viewed from the front and green upon oblique view) is employed in the region 73 as a color function layer (not shown) of this sub-region in the second region, that is, a stroke portion of the letter "B" in the region 73.

A liquid crystal optically variable material (a cholesteric liquid crystal optically variable material which manifests golden when viewed from the front and green upon oblique view) is employed in the region 74 as a color function layer (not shown) of this sub-region in the second region, that is, a stroke portion of the letter "B" in the region 74.

An optically variable coating consisting of $Cr/SiO_2/Al$ (4 nm/360 nm/50 nm) is employed in the region 75 as a color function layer (not shown) of this sub-region in the second region, that is, a stroke portion of the letters "C" and "D" in the region 75, wherein the color of the optically variable coating is green (front) and blue (oblique), and the Cr layer is on the second surface of the substrate 2.

FIGS. 5*b* and 5*c* illustrate the optical features of the optical anti-counterfeiting element formed in the above configuration. Upon rotation, translation or tilting of the optical anti-counterfeiting element, regions 71-75 will exhibit a shift or switching of colors or optically variable patterns in a direction that is orthogonal (or perpendicular) to the direction of sight of the viewer. Specifically, for example, upon rotation of a sample around the rotation axis 81, the letters in regions 71-75 will exhibit the phenomenon that the color or optically variable images moves in the direction indicated by the arrows as shown in FIG. 5*b*, wherein:

The letter "A" with red strokes and white background in the region 71 moves upward;

The letter "B" with green strokes and white background in the region 72 moves downward;

The letter "B" with magenta strokes and white background in the region 73 moves upward and, with increase of the rotation angle, the magenta strokes turn to green;

Therefore, when the green letter "B" in the region 72 moves to the boundary of the regions 72 and 73, the magenta letter "B" in the region 73 also moves to the boundary, resulting in an "annihilation" feature of two letters "B" and during the annihilation the magenta letter changes to the same green color as the letter in region 72.

The letter "B" with golden strokes and white background in the region 74 moves upward and, with increase of the rotation angle, the golden strokes turn to green.

Thus, while "annihilation" occurs to the letter in region 73 at the boundary of regions 72 and 73, the golden letter "B" in region 74 moves toward the boundary of regions 73 and 74, such movement is synchronized with the letter "B" in the region 73. When the letter "B" in the region 74 reaches the boundary of the regions 73 and 74, the letter "B" in the region 73 will appear at the boundary so as to "complement" the portion of the letter "B" actually missing in the region 74, so that the human eye perceives that the letter "B" in the region 74 crosses the boundary of 73 and 74 and its color changes to magenta. At the same time, as the rotation angle continues to increase, the letter "B" in both regions 74, 73 will turn green such that the color of the dynamic letter (golden and magenta) and color change process (golden to magenta) perceived by the human eye both suddenly change (all changed to green).

The letter "C" with green strokes and white background in the region 75 moves upward and, with increase of the rotation angle, the green strokes turn to blue and the letter will be switched to the letter "D" moving upward.

In the above embodiments, specific implementations of the optical anti-counterfeiting features are given. At the same time, it is also proved that there is a strong coupling of the optical structures between the regions comprising coating 21 and different color function layers 222, 223 and a further strong coupling of the optical characteristics.

In the embodiment shown in FIG. 5, the micro-image layers in regions 71-75 are an pattern arrangement having the same array periodicity as the micro-lens array. In fact, they may have different array periodicities depending on the design requirements. Preferably, the relative stagger angle of the arrays may be between −2 degrees and +2 degrees which thereby determine the dynamic amplitude of the sampled and synthesized image.

Figure 6:
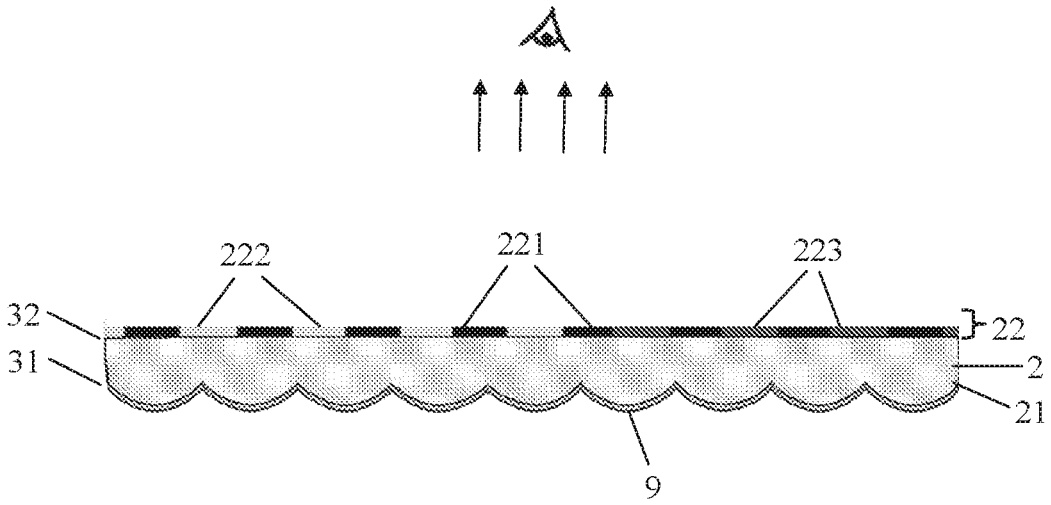
FIG. 6 is a schematic cross-sectional view of an optical anti-counterfeiting element in which a reflective layer is formed on a sampling and synthesizing layer according to one embodiment of the present invention.

The switching feature of the two patterns "C" and "D" in the region 75 in FIG. 5 may also be referred to as "two-channel" feature. In fact, the area under the micro-lens unit may be divided into two or more parts for filling different micro-image information, in order to achieve the switching of multiple patterns, namely, so-called "multi-channel feature". The selected multiple patterns may be associated with each other, for example, several frames, or an animation or a multi-frame movie may be presented in the effect of an image such as enlargement, translation, scaling, or the like. In a further preferred embodiment according to the present invention, as shown in FIG. 6, the optical anti-counterfeiting element according to the present invention may further comprise a reflection layer 9 disposed on the surface of the sampling and synthesizing layer 21 so that the observation direction of the human eye is on the second surface 32 of the substrate 2, that is, after the sampling and synthesizing layer 21 samples and synthesizes the micro-image layer 22, the resulting image will be reflected to the human eye through the reflection layer 9. For the structure and fabrication method of the optical anti-counterfeit element comprising a sampling and synthesizing layer 21 with the reflection layer 9, please refer to China Patent CN104118236, the entire content of which is incorporated into this disclosure by reference.

In addition, at least one of the color function layers 222, 223 and the coating 221 is preferably semitransparent or transparent when the configuration shown in FIG. 6 is adopted, so that light can transmit through the micro-image layer 22 and project into the human eye.

In a further preferred embodiment according to the present invention, the optical anti-counterfeiting element according to the present invention may further comprise one or more of a diffractive optically variable feature, an interference optically variable feature, a micro-nano structural feature, a printing feature, a partially metalized feature, and magnetic, optical, electrical, and radioactive features for machine reading formed on at least one of the substrate 2, the first surface 31 of the substrate 2, the second surface 32 of the substrate 2, the first region, the second region, the sampling and synthesizing layer 21, and the surface of the micro-image layer 22. For example, a fluorescent material (not shown) may be added to the optical anti-counterfeiting element of the present invention so that it has a fluorescent feature. The fluorescent material can form a fluorescent pattern by, for example, printing. For example, replacing the liquid crystal optically variable material severed as the color function layer with the fluorescent material will realize that the fluorescent pattern can satisfy the conditions for sampling and synthesizing, thereby forming a sampled and synthesized fluorescent pattern.

Additionally, the substrate 2 may be at least partially transparent or may be a colored medium layer. In a preferred embodiment, the substrate 2 may be a single-layer transparent medium film, such as a PET film, a PVC film or the like, it may also be a transparent medium film with a functional coating (such as an embossed layer) on the surface, or a composite multi-layer film.

The optical anti-counterfeiting element according to the present invention is particularly suitable for making a security line with opening window. The security line has a thickness of no greater than 50 μm. Anti-counterfeiting paper with such security line with opening window may be used for anti-counterfeiting of various high-security products such as banknotes, passports and securities.

The optical anti-counterfeiting element according to the present invention may also be used as labels, logos, wide strips, transparent windows, laminates, etc., which can be adhered to various articles by various bonding mechanisms, for example, high-security products such as banknotes and credit cards and high value-added products.

In another aspect, the present invention provides a product comprising the optical anti-counterfeiting element, including but not limited to various high-security and high value-added products such as banknotes, credit cards, passports and securities, as well as various wrapping paper, boxes and so on.

Some preferred embodiments of the present invention have been described above by way of example only. However, the present invention is not limited to the specific details of the above embodiments. Various simple modifications may be made to the technical solutions of the present invention within the scope of the technical concept of the present invention, and all these simple modifications fall into the protection scope of the present invention.

In addition, it should be noted that each specific technical feature described in the foregoing specific embodiments may be combined in any suitable manner without contradiction. In order to avoid unnecessary repetition, the present invention does not describe the various possible combinations. Moreover, various embodiments of the present invention may be combined as desired without departing from the scope of the present invention, and should be regarded as the disclosure of the present invention.

The invention claimed is:

1. An optical anti-counterfeiting element comprising:

a substrate having a first surface and a second surface that are opposed to each other;

a sampling and synthesizing layer on a first surface of the substrate; and a micro-image layer on a second surface of the substrate, the micro-image layer including a first region at least partially covered with a coating and a second region comprising at least one first sub-region and at least one second sub-region, wherein the first sub-region is at least partially covered with a first color function layer, the second sub-region at least partially covered with a second color function layer, wherein the first color function layer, the second color function layer and the coating in the first region have different color characteristics from each other, and the micro-image layer can be sampled and synthesized by the sampling and synthesizing layer to form an image.

2. The optical anti-counterfeiting element according to claim 1, wherein the sampling and synthesizing layer is formed of at least one of a micro-pore array, a micro-grid array, a micro-lens array.

3. The optical anti-counterfeiting element according to claim 2, wherein the micro-pore array, the micro-grid array and the micro-lens array are any of a periodic array, a non-periodic array, a random array, and a local periodic array respectively composed of a plurality of micro-pore units, micro-grid units and micro-lens units, or a combination thereof.

4. The optical anti-counterfeiting element according to claim 3, wherein the micro-pore array, the micro-grid array and the micro-lens array present at least one of a square arrangement, a rectangular arrangement, a hexagonal arrangement, a circular arrangement, an elliptical arrangement, and other quadrangular or polygonal arrangement.

5. The optical anti-counterfeiting element according to claim 1, wherein the sampling and synthesizing layer and the micro-image layer have an image period of 10 μm to 200 μm.

6. The optical anti-counterfeiting element according to claim 1, wherein the sampling and synthesizing layer and the micro-image layer have an image period of 15 μm to 50 μm.

7. The optical anti-counterfeiting element according to claim 1, wherein the sampling and synthesizing layer has a focal length of 10 μm to 200 μm.

8. The optical anti-counterfeiting element according to claim 1, wherein the sampling and synthesizing layer has a focal length of 15 μm to 40 μm.

9. The optical anti-counterfeiting element according to claim 1, wherein the sampling and synthesizing layer has a processing depth of less than 15 μm.

10. The optical anti-counterfeiting element according to claim 9, wherein the processing depth is 0.5 μm to 10 μm.

11. The optical anti-counterfeiting element according to claim 1, wherein a difference between a thickness of the substrate and a focal length of the sampling and synthesizing layer is less than 8 μm.

12. The optical anti-counterfeiting element according to claim 1, wherein a difference between a thickness of the substrate and a focal length of the sampling and synthesizing layer is less than 3 μm.

13. The optical anti-counterfeiting element according to claim 3, wherein the micro-pore array, the micro-grid array and the micro-lens array have an array periodicity same with or different from that of the micro-image layer and a stagger angle of −2 degrees to +2 in relation to the micro-image layer.

14. The optical anti-counterfeiting element according to claim 1, wherein the coating or the color function layer is located in a pattern, a pattern background, or a portion of either of a pattern and a pattern background of the micro-image layer.

15. The optical anti-counterfeiting element according to claim 1, further comprising a color function layer covering the coating and including color characteristics same with or different from those of the color function layers in the respective sub-regions.

16. The optical anti-counterfeiting element according to claim 1, wherein the coating is at least one of a single-layer metal coating, a multi-layer metal coating, a single-layer medium layer, a multi-layer medium layer, and an interference-type multilayer film structure.

17. The optical anti-counterfeiting element according to claim 1, wherein the color function layer is at least one of an ink, a pigment, a dye, an optically variable ink, a liquid crystal optically variable layer, a single-layer metal coating, a multilayer metal coating, a single-layer medium layer, a multi-layer medium layer, and an interference-type multilayer film structure.

18. The optical anti-counterfeiting element according to claim 1, further comprising a reflection layer disposed on a surface of the sampling and synthesizing layer, wherein at least one of the color function layers in the respective sub-regions and the coating in the first region is semitransparent or transparent.

19. The optical anti-counterfeiting element according to claim 1, further comprising one or more of a diffractive optically variable feature, an interference optically variable feature, a micro-nano structural feature, a printing feature, a partially metalized feature, and magnetic, optical, electrical, and radioactive features for machine reading formed on at least one of the substrate, the first surface of the substrate, the second surface of the substrate, the first region, the second region, the sampling and synthesizing layer, and a surface of the micro-image layer.

20. An optical anti-counterfeiting product comprising the optical anti-counterfeiting element according to claim 1.

* * * * *